US005502926A

United States Patent [19]

Grace et al.

[11] Patent Number: 5,502,926

[45] Date of Patent: Apr. 2, 1996

[54] VEHICLE DOOR GLASS LIFTPLATE MOUNTING ARRANGEMENT

[75] Inventors: Joseph M. Grace, Bloomfield Hills; Michael A. Puscas, Shelby Township, both of Mich.; Thomas Medebach, Wetzlar, Germany

[73] Assignee: Chrysler Corporation, Highland Park, Mich.

[21] Appl. No.: 311,972

[22] Filed: Sep. 26, 1994

[51] Int. Cl.[6] ..... E05F 11/38

[52] U.S. Cl. ..... 49/375; 411/103

[58] Field of Search ..... 49/374, 375; 411/103, 411/105, 108, 182

[56] References Cited

U.S. PATENT DOCUMENTS

| | | | |
|---|---|---|---|
| 3,050,332 | 8/1962 | Arnold | 49/375 X |
| 3,703,053 | 11/1972 | De Rees et al. | 49/375 X |
| 4,464,091 | 8/1984 | Molina | 411/105 |
| 4,475,314 | 10/1984 | Faix et al. | 49/374 |
| 4,848,032 | 7/1989 | Ballor et al. | 49/350 |
| 4,952,107 | 8/1990 | Dupree | 411/103 |
| 5,341,599 | 8/1994 | Cox | 49/375 |

FOREIGN PATENT DOCUMENTS

| | | | |
|---|---|---|---|
| 568409 | 11/1993 | European Pat. Off. | 49/375 |
| 597764 | 5/1994 | European Pat. Off. | 49/375 |
| 193713 | 7/1990 | Japan | 49/375 |

*Primary Examiner*—Jerry Redman
*Attorney, Agent, or Firm*—Thomas G. Pasternak

[57] ABSTRACT

An improved liftplate attachment arrangement used to support an automotive door window. The liftplate is formed with a recessed attachment area adjacent a bracket which supports a lower edge of the window. The window, having a circular hole, is fixedly attached at the recessed area by means of a retainer assembly comprising a plastic disc-cap encasing a T-nut. The T-nut has a central internally threaded tubular portion concentrically surrounded by a plurality of disc-cap spring fingers, the inboard ends of which are formed with radially extending crossheads the outer ends of which are adapted for snap-in reception in the window hole. A screw shank, after being passed though a slot in the liftplate recess, is threaded in the T-nut tubular portion, while the shank blocks juxtaposed inner ends of the crosshead from being flexed inward for release of the fingers thereby locking the retainer assembly against removal. Upon positioning the window on the liftplate, a retainer anti-rotational tongue engages a stop on the liftplate obviating retainer assembly slippage while the screw is tightened.

9 Claims, 3 Drawing Sheets

VEHICLE DOOR GLASS LIFTPLATE MOUNTING ARRANGEMENT

BACKGROUND OF THE INVENTION

This invention relates generally to door glass sheet mountings for vehicles and more particularly to an improved mounting arrangement for attaching the glass sheet to a liftplate movable within a car door.

One example of a prior art vehicle glass mounting arrangement is disclosed in the U.S. Pat. No. 4,848,032 issued Jul. 18, 1989 to Ballor et al. entitled Arrangement For Mounting Automotive Glass to Liftplate. In the Ballor et al. patent a plastic spacer bushing, having a through bore formed with an internal left-hand thread, is sandwiched between the glass sheet and the liftplate. A retainer assembly includes a plastic capped retainer, having an external left-hand threaded system portion, and a metal T-nut. The T-nut head portion is concentrically anchored to the retainer cap portion with the T-nut tubular portion, having a right-hand internally threaded bore, telescopically received within the stem portion bore. The retainer stem portion is inserted through a hole in the glass sheet and is formed with its left-hand external thread engaging the bushing bore internal left-hand thread. The liftplate is secured to the glass sheet by a bolt having a right-hand threaded stem passed through a liftplate aperture for engagement with a T-nut internally threaded tubular portion. Upon initial tightening of the bolt the flex ring is readily deformed for flush tight contact of the spacer rim with both the glass sheet and the liftplate. The counter-clockwise tightening of the bushing left-hand thread on the stem portion obviates slippage of the retainer during clockwise torquing of the bolt. Further, the bushing rim portion clamping load is removed from the edge of the glass sheet hole thus obviating glass sheet breakage.

SUMMARY OF THE INVENTION

Accordingly, it is an object of the present invention to provide a novel and improved automotive door window liftplate mounting arrangement requiring minimal assembly line installation time.

It is another object of the present invention to provide an improved automotive door window liftplate mounting arrangement for a as set forth above wherein a reduction in the number of parts reduces manufacturing costs.

Another object of this invention is to provide a novel and improved automotive door window liftplate anti-rotational mounting arrangement thereby obviating spinning of the window retainer assembly when a securing screw is threaded into a retainer T-nut.

It is still another object of the invention to provide a mounting arrangement as set forth above wherein, upon threaded insertion of the screw in a window mounting hole, the retainer assembly is positively locked against removal.

BRIEF DESCRIPTION OF THE DRAWINGS

Other features and advantages of the invention, such as reduced number of parts and improved adjustability, will be evident from the following detailed description of the preferred embodiment of the invention and the accompanying drawings wherein.

DETAILED DESCRIPTION OF THE PREFERRED EMBODIMENT

Figure 1:
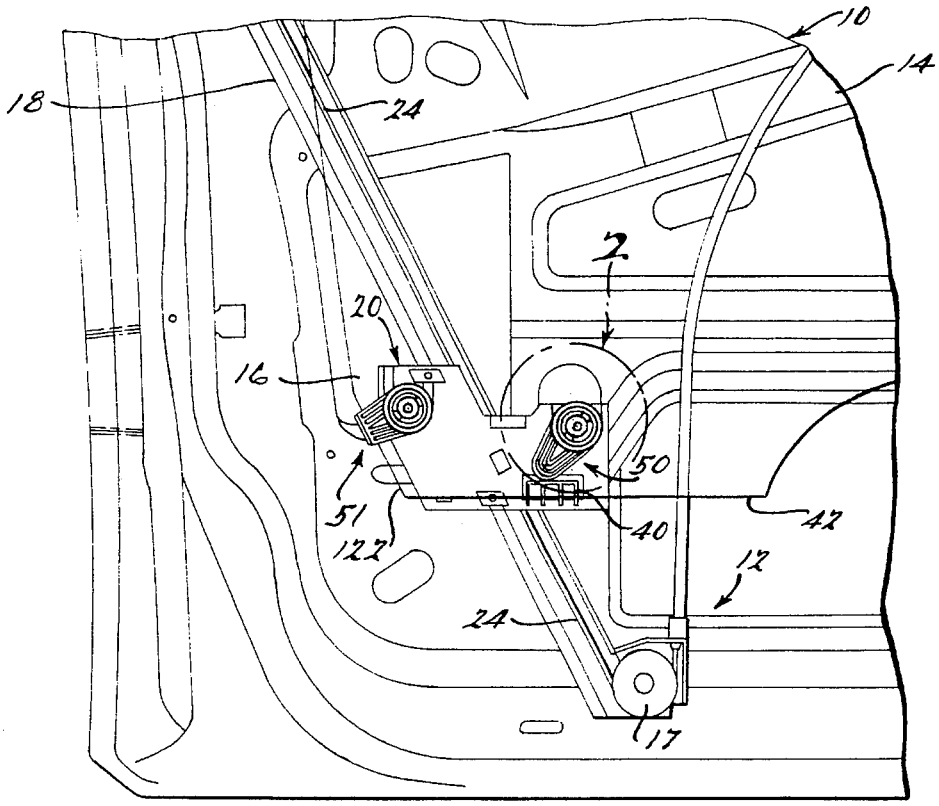
FIG. 1 is a fragmentary elevational view of the inner structural frame of the present invention as installed in a vehicle door.

Referring now to FIG. 1 of the drawings, there is shown a portion of the inner frame a motor vehicle door 10 having a window regulator cable drive assembly 12 mounted on inner door panel 14 operative to open and close a sheet of window glass 16 in a door upper window opening (not shown). The window glass regulator assembly 12 comprises two horizontally spaced upright guide channels with only the rearward channel being shown at 18. The channels are bent into the configuration illustrated in FIG. 1 to conform to the interior of the door well defined between the door's inner panel 14 and outer panel (not shown). The bottom of the window glass is secured to a pair of liftplates the rearward one of which is generally indicated by reference numeral 20. The drive cable assembly 12 enables force to be transmitted to the liftplates for lifting and lowering the window glass 16. Cable guide pulleys, one of which is shown at 17 attached to the window channel 18, support flexible cables such as cable 24 for sliding movement. The cables are attached at one end to a take-up mechanism mounted on the window glass. An example of a cable window regulator is shown and described in U.S. Pat. No. 4,970,827 issued Nov. 20, 1990 to Djordjevic, the disclosure of which is incorporated by reference herein. Reference may be had to the Djordjevic patent for a detailed description of one type of cable regulator system.

Figure 6:
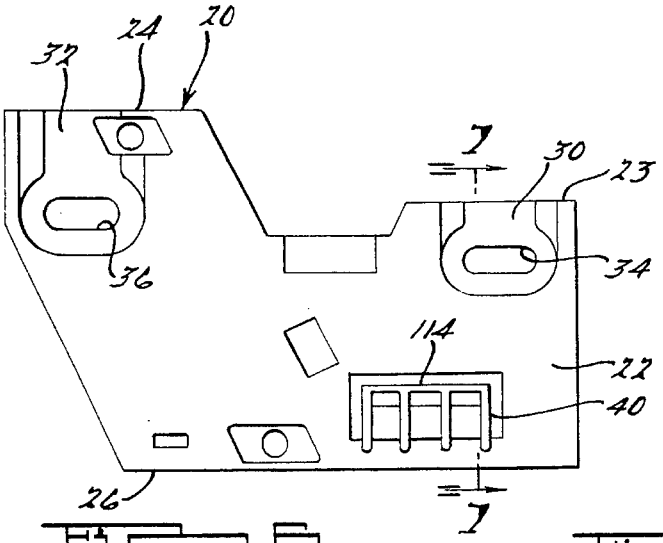
FIG. 6 is a detail view of the inboard side of the liftplate.
Figure 7:
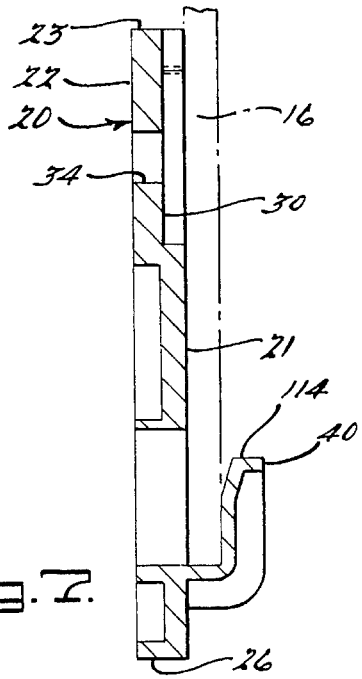
FIG. 7 is a vertical sectional view taken on the line 7—7 of FIG. 6.
Figure 8:
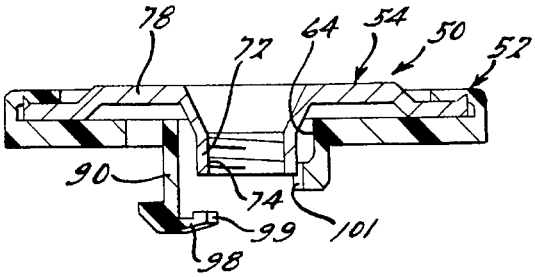
FIG. 8 is a sectional view taken on the line 8—8 of FIG. 3.

Turning now to a preferred embodiment of the instant invention, FIG. 6 shows the liftplate 20 compassing a generally rectangular-shaped member having an outboard surface 21 and an inboard surface 22. The liftplate is defined in part by a pair of upper offset forward 23 and rearward 24 horizontal edges and a lower horizontal edge 26. The outboard surface 21 is formed with a forward recess 30, having an upwardly facing opening in upper forward edge 23, and a rearward recess 32, having an upwardly facing opening in upper rearward edge 24. The forward and rearward recesses 30 and 32 respectively, which define window attaching areas, are both provided with horizontally extending through slots 34 and 36 respectively. FIG. 7 shows an L-shaped window supporting angle bracket 40 projecting outboard from a lower portion of the liftplate outboard surface 21 adapted to receive the lower edge 42 (FIG. 1) of the window 16.

Figure 2:
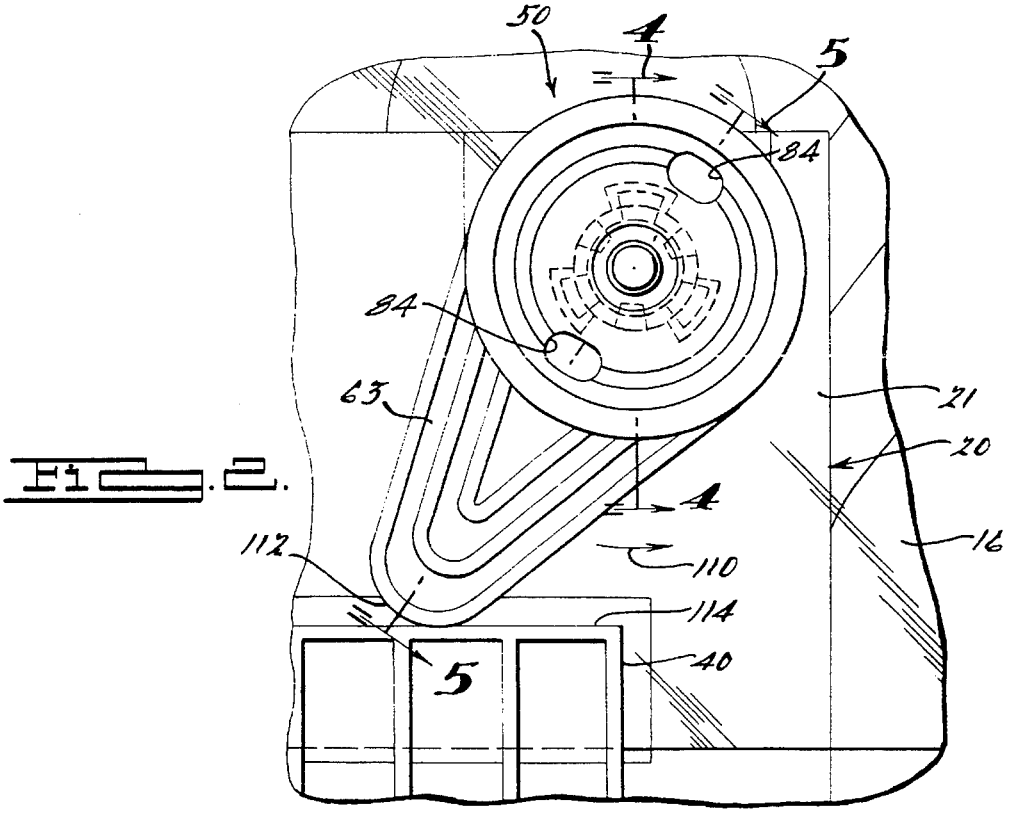
FIG. 2 is an enlarged view of a portion of FIG. 1 enclosed by broken line identified as FIG. 2.

With reference to FIG. 2 there is shown a portion of the liftplate outboard surface 21 supporting a window retainer assembly generally indicated at 50. FIG. 1 shows a pair of retainer assemblies, generally indicated at 50 and 51, are provided to secure the window 16 to the liftplate outboard surface.

Figure 4:
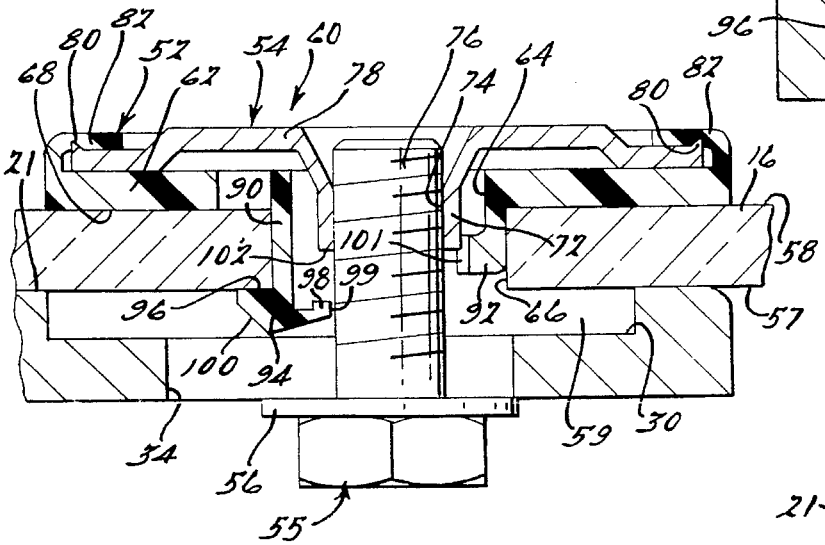
FIG. 4 is fragmentary sectional view taken on the line 4—4 of FIG. 2.
Figure 9:
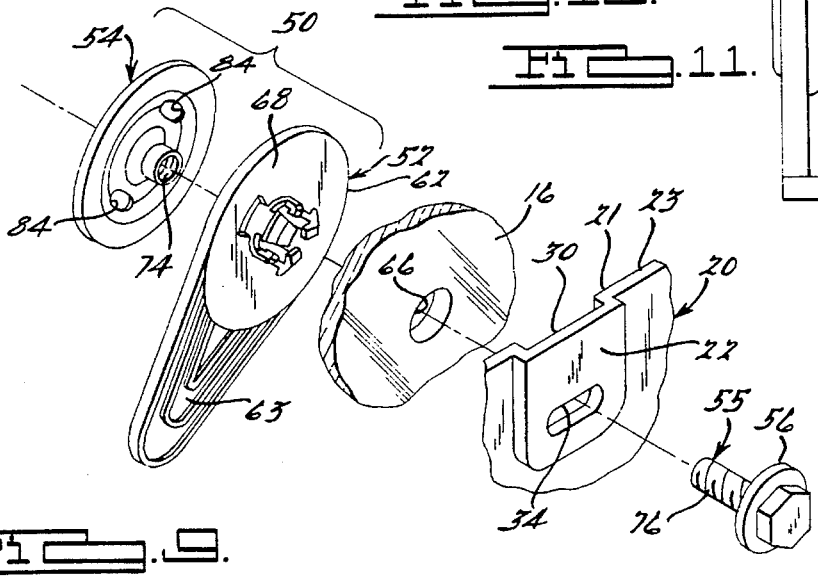
FIG. 9 is an exploded fragmentary perspective view of the mounting arrangement for attaching window to a liftplate in an automotive door in accordance with the present invention.

As seen in FIG. 9 the retainer assembly 50 comprises a plastic capped retainer 52, a metallic T-nut 54, a screw or machine bolt 55, and a conical washer 56. The machine bolt 55 and the conical washer 56 thereon is shown in FIG. 4 extending through the liftplate recess slot 34 for securing the retainer 52 to the window outboard surface 58. It will be noted in FIG. 9 that the liftplate recess 30 provides a predetermined clearance gap 59 between the recess 30 and the inboard surface 58 of the window for a reason explained below.

Figure 3:
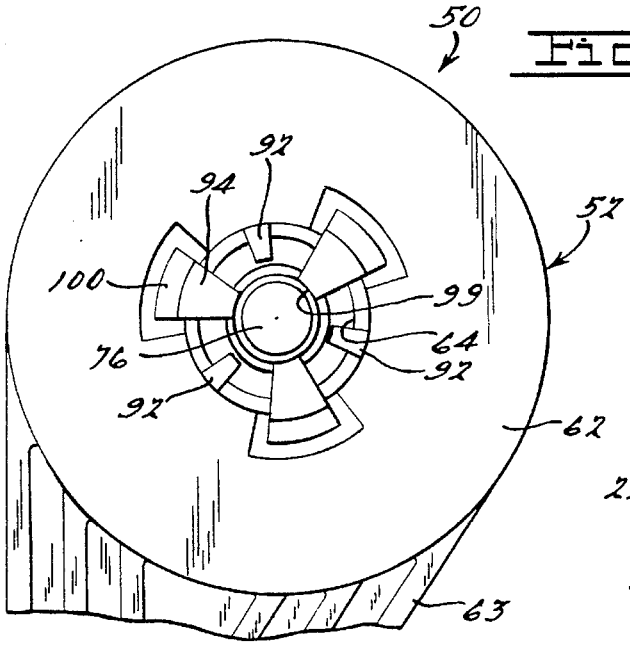
FIG. 3 is an enlarged fragmentary detail view of the circular mounting portion of the retainer assembly of FIG.

FIGS. 3, 4, and 9 show a one-piece plastic retainer 52 comprising a circular or disc-like cap 62 molded with a co-planar anti-rotational tongue 63 of predetermined radial extent. The cap 62 is formed with a central circular hole 64 having its center adapted for alignment with a window circular hole 66 and adapted to overlie the liftplate attaching area defined by the liftplate forward recess 30.

The cap 62 and antirotational tongue 63 have a common undersurface 68 adapted for flush contact with the window outboard surface 58. A stamped metal T-nut 54 has a hollow central tubular portion 72 formed with an internal right-hand thread 74 for receiving threaded shank 76 of the machine bolt 55 after its insertion through its associated liftplate recess elongated aperture 34 and cap central hole 64. The T-nut 54 is formed with a radially extending integral anchoring head portion 78 having its periphery formed with a plurality of spaced barbs 80 extending axially outboard in the opposite direction as the tubular portion 72. The T-nut tubular portion 72, upon being telescopically received in the central hole 64 of the circular cap 62, has its head portion 78 captured in a partially encased manner by molding peripheral hem 82. The hem edge is rolled to engage the barbs 80 as seen in FIG. 4. It will be noted in FIG. 2 that the T-nut head portion 78 has a pair of opposed slotted openings 84 therein adapted to be engaged by a suitable spanner wrench or tool for applying a torque to the retainer assembly 50.

With reference to FIG. 4 it will be seen that the retainer cap 62 has its central circular hole 64 concentrically overlying the window hole 66 with its undersurface 68 in flush contact with the window outboard surface 58. The periphery of the cap central hole is formed with a plurality of inboard extending uniformly spaced resilient fingers 90. It will be seen in FIG. 3 that in the preferred embodiment three fingers 90 are shown equally spaced on 120 degree centers. The fingers 90 are interspersed with three uniformly spaced inboard extending tabs 92 also spaced on 120 degree centers.

Each finger inboard free end terminates in a radially disposed crosshead 94 defining a radially outwardly-extending stepped shoulder 96 and a radially inwardly-extending locking prong 98. Each finger crosshead 94 is formed with a radially outwardly and tapered pilot portion 100 facilitating insertion through the window hole 66 whereby its shoulder 96 is urged into flush engagement with the window inboard surface 57. Further, each finger locking prong 98 has its free radially inner end 99 positioned juxtaposed the bolt shank 76. The three prongs are operative to lock the finger shoulders 96 in contact with the window inboard surface obviating release of the retainer assembly 50. It will be noted in FIG. 3 that each tab inner end 101 is in the form of a concave circular arc, when viewed in horizontal section, concentrically juxtaposed about the principal axis of the bolt shank 76.

It will be noted in FIG. 4 that the tabs 92 extend into the window hole 66 a predetermined axial dimension less than the shoulders 96 and a predetermined axial dimension greater than T-nut tubular portion inboard distal end 102.

Figure 5:
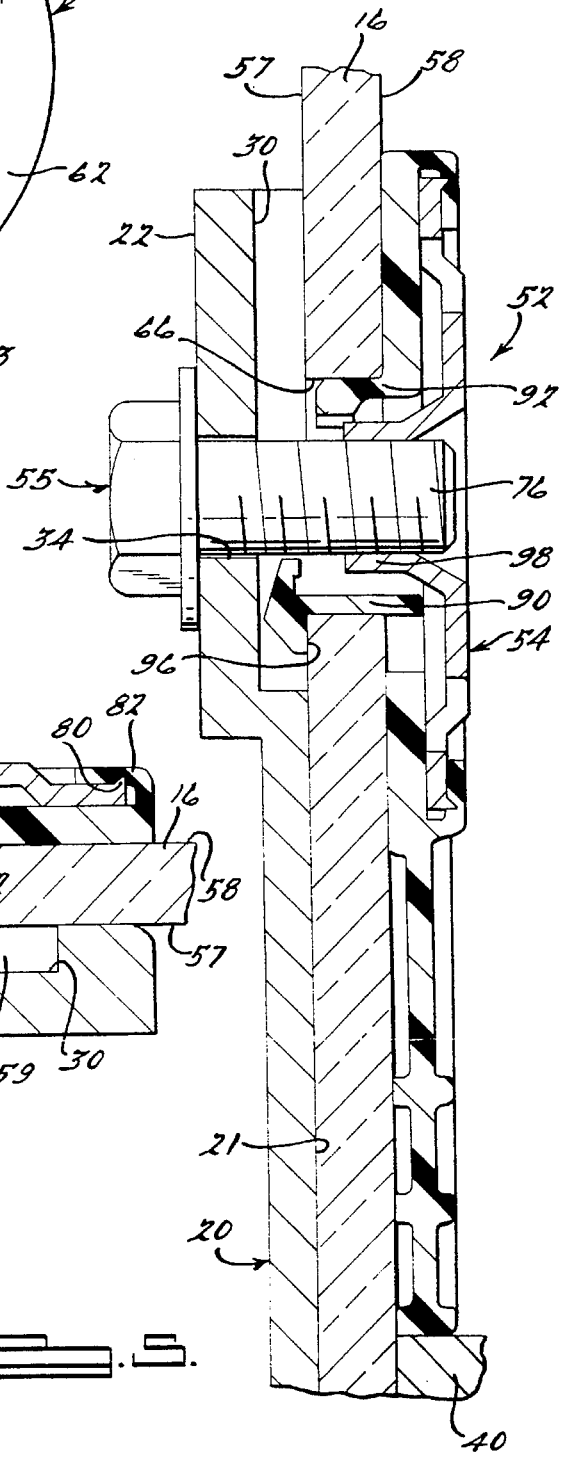
FIG. 5 is a fragmentary sectional view taken on the line 5—5 of FIG. 2.

In operation the assembler inserts the retainer fingers 90 in the window hole 66 as seen in FIG. 5 and tightens the screw 55 in the T-nut stem 72 by a in a clockwise rotational direction allowing the liftplate 20 to be drawn into flush pressure contact with the window inboard surface. This results because the retainer antirotational tongue 63 rotates in a counter clockwise direction, as viewed by the arrow 110 in FIG. 2, such that its radiused free end 112 engages upper edge 114 of the liftplate bracket 40 obviating slippage of the retainer.

Figure 10:
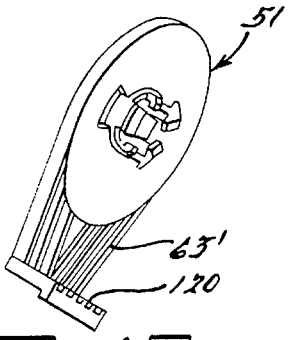
FIG. 10 is a perspective view of a modified retainer assembly shown at 51 in FIG. 1.
Figure 11:
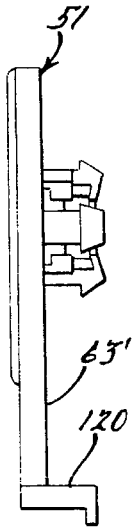
FIG. 11 is a side view of the retainer assembly of FIG. 10.

With reference to FIGS. 1 and 10 it will be seen that the retainer assembly 51 is identical to the retainer assembly 50 with the exception that the anti-rotational tongue 63' has its free end formed with a right-angled flange 120. As seen in FIG. 2 the flange 120 is adapted for flush engagement with window side edge 122 thereby obviating rotation of the retainer assembly 51 upon the assembler tightening its bolt 55.

Reasonable modifications and variations of the above-described illustrative embodiment of the invention are possible without departing from the spirit and scope of the invention which is defined in the appended claims.

We claim:

1. In a window mounting arrangement for a vehicle window having inboard and outboard surfaces and a circular window hole spaced from a marginal edge thereof, said arrangement comprising:

a generally rectangular-shaped liftplate comprising inboard and outboard surfaces defined in part by upper and lower edges;

a retainer assembly adapted for positioning on the window outboard surface comprising a plastic capped retainer member, a bolt, and a metal T-nut member, said retainer member defining a circular radially extending disc-shaped cap having a central circular hole concentrically overlying the window hole, said cap having an undersurface in flush contact with the window outboard surface, said T-nut member having an anchoring head extending radially from one outboard proximate end of a hollow internally threaded tubular portion terminating in an inboard distal end, and means locking said anchoring head against relative rotation on an outboard surface of said cap, the improvement in the window mounting arrangement comprising;

a window attaching area on the liftplate outboard surface adjacent said upper edge and recessed inboard from one inboard window supporting surface, an elongated aperture in said area in registry with the window hole;

said cap central hole having its periphery formed with a plurality of inboard extending uniformly spaced resilient fingers interspersed with a plurality of inboard extending uniformly spaced tabs, each said finger terminating in a crosshead adapted for reception in the window recessed attaching area, each said crosshead providing a radially outwardly-extending stepped shoulder and a radially inwardly-extending locking prong, each said finger adapted for axial snap-in insertion in the window hole with its shoulder urged into engagement with the window inboard surface, each said finger locking prong having a radially inner free end juxtaposed a bolt shank extending through the liftplate aperture and the window hole for engagement with said T-nut internal thread;

said tabs extending a predetermined axial dimension inboard into the window hole less than said shoulders and greater than said T-nut tubular portion distal end, each said tab having a foot extending radially inward and terminating in a free inner end juxtaposed said tubular portion; and said retainer member formed with anti-rotational means adapted for engaging stop limit means on said lift plate obviating rotation of said retainer assembly upon said bolt being tightened in said T-nut internally threaded tubular portion.

2. The window mounting arrangement as set forth in claim 1 wherein said anti-rotational means in the form of a co-planar tongue of predetermined radial extent.

3. The window mounting arrangement as set forth in claim 2 wherein said anti-rotational tongue having its free end terminating in a radiused free end.

4. The window mounting arrangement as set forth in claim 1 wherein said stop means protruding from said liftplate outboard surface.

5. The window mounting arrangement as set forth in claim 4 wherein said stop means in the form of a bracket adapted to engage an edge of the window.

6. The window mounting arrangement as set forth in claim 1 wherein each said finger crosshead formed with a tapered pilot portion to facilitate insertion through said window hole.

7. The window mounting arrangement as set forth in claim 1 wherein each said finger locking prong inner free end defining a concave arcuate portion having its center of curvature aligned on the axis of said cap central hole.

8. The window mounting arrangement as set forth in claim 1 wherein each said tab extending inboard a predetermined axial dimension less than said shoulders and greater than said T-nut tubular portion inboard distal end.

9. The window mounting arrangement as set forth in claim 1 wherein said anti-rotational means in the form of a co-planar tongue having its free end terminating in a right-angled flange adapted to engage an edge of the window.

* * * * *